US011591532B2

(12) United States Patent
Leal et al.

(10) Patent No.: US 11,591,532 B2
(45) Date of Patent: Feb. 28, 2023

(54) LEAD-FREE GASOLINE BLEND

(71) Applicant: SABIC Global Technologies B.V., Bergen op Zoom (NL)

(72) Inventors: Guillermo Leal, Riyadh (SA); Vinodkumar Vasudevan, Riyadh (SA); Somak Paul, Riyadh (SA); Kamalakar Gunda, Riyadh (SA)

(73) Assignee: SABIC GLOBAL TECHNOLOGIES B.V., Bergen op Zoom (NL)

( * ) Notice: Subject to any disclaimer, the term of this patent is extended or adjusted under 35 U.S.C. 154(b) by 0 days.

(21) Appl. No.: 17/600,447

(22) PCT Filed: Mar. 27, 2020

(86) PCT No.: PCT/IB2020/052953

§ 371 (c)(1),
(2) Date: Sep. 30, 2021

(87) PCT Pub. No.: WO2020/201964

PCT Pub. Date: Oct. 8, 2020

(65) Prior Publication Data

US 2022/0162511 A1 May 26, 2022

Related U.S. Application Data

(60) Provisional application No. 62/828,067, filed on Apr. 2, 2019.

(51) Int. Cl.
*C10L 1/02* (2006.01)
*C10L 1/10* (2006.01)
(Continued)

(52) U.S. Cl.
CPC ..... *C10L 1/026* (2013.01); *C10L 1/103* (2013.01); *C10L 1/182* (2013.01); *C10L 10/10* (2013.01);
(Continued)

(58) Field of Classification Search
CPC ..... C10L 1/026; C10L 1/103; C10L 1/182; C10L 10/10; C10L 2200/0423; C10L 2230/22; C10L 2270/023; C10L 1/023
See application file for complete search history.

(56) References Cited

U.S. PATENT DOCUMENTS

| | | | |
|---|---|---|---|
| 6,858,048 B1 | 2/2005 | Jimeson et al. | |
| 8,968,429 B2 | 3/2015 | Baustian et al. | |
| 10,041,016 B2 | 8/2018 | Shaik et al. | |
| 11,332,684 B2 * | 5/2022 | Leal | C10L 1/1824 |
| 2009/0151232 A1 | 6/2009 | Hashimoto et al. | |

(Continued)

FOREIGN PATENT DOCUMENTS

| | | |
|---|---|---|
| CN | 1276409 A | 12/2000 |
| CN | 1966626 A | 5/2007 |

(Continued)

OTHER PUBLICATIONS

International Search Report for International Application No. PCT/IB2020/052953; International Filing Date Mar. 27, 2020; dated Jul. 1, 2020; 8 pages.

(Continued)

*Primary Examiner* — Pamela H Weiss
(74) *Attorney, Agent, or Firm* — Cantor Colburn LLP

(57) ABSTRACT

An unleaded gasoline composition comprises, based on the total volume of the unleaded gasoline composition, 50 to 96 vol. % of an unleaded gasoline; 2 to 20 vol. % of a mixed butanol; and 2 to 30 vol. % of a distillate oil fraction comprising a paraffin, an olefin, a naphthene, and an aromatic at an initial boiling point cut of 180° C., wherein the unleaded gasoline, the mixed butanol, and the distillate oil fraction are selected to provide the unleaded gasoline composition with a Research Octane Number of 90 to 101, determined in accordance with ASTM D 2699; and a Motor Octane Number of 81.4 to 90, determined in accordance with ASTM D 2700.

17 Claims, 3 Drawing Sheets

(51) Int. Cl.
*C10L 1/182* (2006.01)
*C10L 10/10* (2006.01)

(52) U.S. Cl.
CPC ... *C10L 2200/0423* (2013.01); *C10L 2230/22* (2013.01); *C10L 2270/023* (2013.01)

(56) References Cited

U.S. PATENT DOCUMENTS

| | | | | |
|---|---|---|---|---|
| 2011/0023355 | A1 | 2/2011 | Xu et al. | |
| 2012/0090226 | A1 | 4/2012 | Lamoureaux et al. | |
| 2013/0247453 | A1 | 9/2013 | Baustian et al. | |
| 2015/0007489 | A1 | 1/2015 | Aubry | |
| 2015/0184095 | A1* | 7/2015 | Landschof | C10L 1/023 44/451 |
| 2017/0321136 | A1* | 11/2017 | Orlebar | C10L 1/1616 |

FOREIGN PATENT DOCUMENTS

| | | | |
|---|---|---|---|
| JP | 2004197061 | A | 7/2004 |
| WO | 9324593 | | 12/1993 |
| WO | 2016075166 | A1 | 5/2016 |
| WO | 2018215881 | A1 | 11/2018 |

OTHER PUBLICATIONS

Rakopoulos et al.; "Effects of butanol-diesel fuel blends on the performance and emissions of a high-speed DI diesel engine"; Energy Conversion and Management, vol. 51; 2010; pp. 1989-1997.

Written Opinion for International Application No. PCT/IB2020/052953; International Filing Date Mar. 27, 2020; dated Jul. 1, 2020; 9 pages.

* cited by examiner

LEAD-FREE GASOLINE BLEND

CROSS REFERENCE TO RELATED APPLICATIONS

This application is a National Stage application of PCT/IB2020/052953, filed Mar. 27, 2020, which claims the benefit of U.S. Provisional Application No. 62/828,067, filed Apr. 2, 2019, both of which are incorporated by reference in their entireties herein.

BACKGROUND

This application relates to lead free gasoline compositions comprising octane-boosting additives and methods of making the gasoline compositions.

Commercial gasoline, which is fuel for internal combustion engines, is a refined petroleum product that is typically a mixture of hydrocarbons (base gasoline), additives, and blending agents. Additives and blending agents, for example octane boosters, are added to the base gasoline to enhance the performance and the stability of gasoline.

When used in high compression internal combustion engines, gasoline has the tendency to "knock." Knocking occurs when combustion of the air/fuel mixture in the cylinder does not start off correctly in response to ignition because one or more pockets of air/fuel mixture pre-ignite outside the envelope of the normal combustion front. Anti-knocking agents, also known as octane boosters, reduce the engine knocking phenomenon, and increase the octane rating of the gasoline. Prior octane boosters such as tetraethyl lead and methylcyclopentadienyl manganese tricarbonyl ("MMT") have been or are being phased out for environmental, health, or other reasons.

Preferred compounds in present use for formulating octane boosters include $C_4$ oxygenate compounds such as methyl tert-butyl ether ("MTBE"), ethyl tert-butyl ether ("ETBE"), and n-butanol and its isomers. However, the production and storage of the large quantities of these materials at oil refineries can be costly. In addition, limitations on the use of high concentrations of additives by regulatory mandate increase the difficulty and expense of refining operations that produce high-octane fuels. There is a need for a fuel additive or fuel that has an octane rating that is comparable to gasoline and that has increased combustion efficiency.

In view of the foregoing, there remains a need to provide cost-effective gasoline compositions including octane-enhancing compositions.

BRIEF DESCRIPTION

Disclosed, in various embodiments, are lead-free gasoline compositions comprising octane-enhancing additives and methods of making the gasoline compositions.

The present disclosure provides an unleaded gasoline composition comprising 50 to 96 volume percent ("vol. %") of an unleaded gasoline, based on the total volume of the unleaded gasoline composition; 2 to 20 vol. % of a mixed butanol, based on the total volume of the unleaded gasoline composition; and 2 to 30 vol. %, based on the total volume of the unleaded gasoline composition, of a distillate oil fraction comprising a paraffin, an olefin, a naphthene, and an aromatic at an initial boiling point cut of 180° C., wherein the unleaded gasoline, the mixed butanol, and the distillate oil fraction are selected to provide the unleaded gasoline composition with a Research Octane Number of 90 to 101, determined in accordance with ASTM D 2699; and a Motor Octane Number of 81.4 to 90, determined in accordance with ASTM D 2700; and wherein the total volume of the unleaded gasoline composition is 100 vol. %.

The present disclosure provides a method for preparing an unleaded gasoline composition, comprising combining 55 to 96 vol. % of an unleaded gasoline, based on the total volume of the unleaded gasoline composition; 2 to 20 vol. % of a mixed butanol, based on the total volume of the unleaded gasoline composition; and 2 to 30 vol. %, based on the total volume of the unleaded gasoline composition, of a distillate oil fraction comprising, a paraffin, an olefin, a naphthene, and an aromatic at an initial boiling point cut of 180° C., wherein the unleaded gasoline, the mixed butanol and the distillate oil fraction are selected to provide the unleaded gasoline composition with a Research Octane Number of 91 to 101, determined in accordance with ASTM D 2699; and a Motor Octane Number of 81.4 to 90, determined in accordance with ASTM D 2700; and wherein the total volume of the unleaded gasoline composition is 100 vol. %.

The present disclosure provides an octane-enhancing additive comprising 5 to 95 vol. % of a mixed butanol and 5 to 95 vol. % of a distillate oil fraction comprising a paraffin, an olefin, a naphthene, and an aromatic at an initial boiling point cut of 180° C., based on the total volume of the octane-enhancing additive; and wherein the total volume of the octane-enhancing additive is 100 vol. %.

The above described and other features are exemplified by the following figures and detailed description.

BRIEF DESCRIPTION OF THE DRAWINGS

The following figures are exemplary embodiments wherein the like elements are numbered alike.

DETAILED DESCRIPTION

Figure 1:
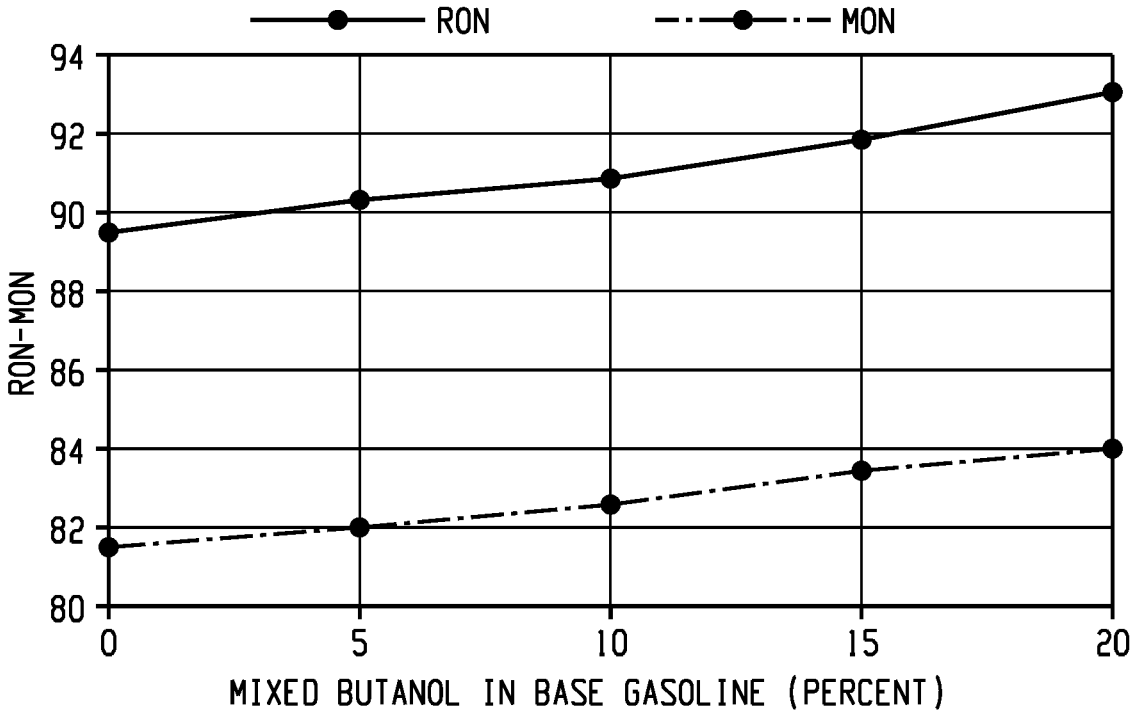
FIG. 1 is a graph of measured Research Octane Number ("RON") or Motor Octane Number ("MON") as a function of the amount of mixed butanol in a gasoline blend.

Disclosed herein are unleaded gasoline compositions comprising a specific distillate oil fraction and a mixed butanol, and methods of making the unleaded gasoline compositions. The distillate oil fraction is also referred to herein as a special oil fraction. An octane-enhancing additive comprising the mixed butanol and the specific distillate oil fraction is also disclosed. The distillate oil fraction can be obtained from steam cracking and other petrochemical production processes. Addition of the distillate oil fraction to an unleaded gasoline comprising the mixed butanol results in a gasoline composition having higher Research Octane Number ("RON") and the Motor Octane Number ("MON") values compared to the RON and MON values of the unleaded gasoline comprising the mixed butanol in the absence of the distillate oil fraction, providing improved combustion and improved performance in internal combustion engines, particularly for the automotive market. Additionally, the gasoline composition is characterized by a lower Reid vapor pressure ("Rvp") than the unleaded gasoline comprising the mixed butanol but without the distillate oil fraction. The gasoline composition has the advantages of performing as well as or better than MTBE-containing unleaded gasolines, while permitting refiners to use less expensive blending components to achieve the desired performance characteristics.

The present disclosure provides for an unleaded gasoline composition that comprises 50 to 96 volume percent ("vol. %") of an unleaded gasoline; 2 to 20 vol. %, or 5 to 20 vol. % of a mixed butanol; and 2 to 30 vol. %, or 5 to 30 vol. % of a distillate oil fraction disclosed herein, based on the total volume of the unleaded gasoline composition. The distillate oil fraction comprises a paraffin, an olefin, a naphthene, and an aromatic at an initial boiling point cut of 180° C. The unleaded gasoline, mixed butanol, and the distillate oil fraction are selected to provide the unleaded gasoline composition with a RON in the range 90 to 101, preferably 91 to 101, and a MON in the range 81.4 to 90, preferably 82.5 to 90.

The unleaded gasoline can comprise greater than 50 vol. % of hydrocarbons having a boiling point of 30 to 230° C., based on the total volume of the unleaded gasoline.

RON describes knocking behavior at a low engine load and low rotational speeds and is determined according to ASTM D2699.

Addition of the mixed butanol and the distillate oil fraction to the unleaded gasoline can increase the RON of the unleaded gasoline composition compared to the RON of the unleaded gasoline without the mixed butanol and the distillate oil fraction. For example, the unleaded gasoline composition can have a RON at least 0.5 point higher, at least 1.0 point higher, at least 1.5 points higher, at least 2.0 points higher, at least 3.0 points higher, at least 4.0 points higher, or at least 5.0 points higher than the RON of the unleaded gasoline without the mixed butanol and the distillate oil fraction.

MON describes knocking behavior at a high engine load and under high thermal stress and is determined according to ASTM D2700.

The unleaded gasoline composition can have a MON at least 0.4 point higher, or at least 0.6 point higher, or at least 0.8 point higher than the MON of the unleaded gasoline without the mixed butanol and the distillate oil fraction. The unleaded gasoline composition can have a MON that is 0.4 to 10, or 0.6 to 8, or 0.8 to 5 points higher than the MON of the unleaded gasoline without the mixed butanol and the distillate oil fraction.

Rvp is a measure of the volatility of gasoline. It is defined as the absolute vapor pressure exerted by a liquid (e.g., gasoline) at 100° F. (37.8° C.) as determined by test method ASTM D323.

The unleaded gasoline composition can have a Rvp lower than the unleaded gasoline without the mixed butanol and the distillate oil fraction. The unleaded gasoline composition can be characterized as having a Rvp of 39.3 to 53.8 kilopascal ("kPa") (5.7 to 7.8 pounds per square inch ("psi")), or 40 to 47.6 kPa (5.8 to 6.9 psi). The unleaded gasoline composition can have a Rvp at least 2.1 kPa (0.3 psi) lower, at least 2.8 kPa (0.4 psi) lower, at least 3.4 kPa (0.5 psi) lower, at least 4.8 kPa (0.7 psi) lower, at least 6.2 kPa (0.9 psi) lower, or at least at least 6.9 kPa (1.0 psi) lower than the Rvp of the unleaded gasoline without the mixed butanol and the distillate oil fraction.

The composition of the distillate oil fraction can comprise 0.08 to 5 vol. % of n-paraffins; 20 to 40 vol. % of iso-paraffins; 2 to 16 vol. % of olefins; 0.5 to 12 vol. % of naphthenes; and 35 to 65 vol. % of aromatics (based on the total volume of the distillate oil fraction), determined in accordance with ASTM D6730. Preferably, the composition of the distillate oil fraction comprises 0.15 to 1.5 vol. % of n-paraffins, 24 to 35 vol. % of iso-paraffins, 5 to 13 vol. % of olefins, 1 to 9 vol. % of naphthenes, and 45 to 60 vol. % of aromatics. More preferably the composition of the distillate oil fraction comprises 0.25 to 1.0 vol. % of n-paraffins, 26 to 33 vol. % of iso-paraffins, 7 to 11 vol. % of olefins, 2 to 8 vol. % of naphthenes, and 48 to 57 vol. % of aromatics.

"Butanol" refers to a straight chain or branched compound having a molecular formula $C_4H_9OH$. The mixed butanol can comprise at least one of sec-butanol, tert-butanol, n-butanol, isobutanol, or others, and can also comprise a combination thereof.

Mixed butanols can be derived from various sources, including reactions to derive butanols from fossil fuels or through fermentation of biomass from bacteria. In certain embodiments, the mixed butanol is provided as SUPERBUTOL™, a mixture of one or more butanol isomers mixed with other components. For example, one SUPERBUTOL™ composition can include butanol isomers (about 93 vol. %), with small amounts of sec-butyl ether (about 2 vol. %) and di-isobutylene (about 5 vol. %). In some embodiments, SUPERBUTOL™ compositions may also include $C_4$ dimers.

The term "oxygenate" or "octane booster" refers to a class of gasoline additives that contain one or more oxygen atoms and are effective to improve the octane rating of gasoline by increasing the oxygen content of the gasoline. Most oxygenates are either alcohols or ethers.

The unleaded gasoline composition can further comprise 1 to 15 vol. % of an octane booster comprising at least one of a monoaromatic compound, alcohol, ester, or ether. The octane booster can comprise at least one of xylene, benzene, toluene, aniline, methanol, ethanol, isopropyl alcohol, n-propyl alcohol, tert-amyl alcohol, tert-pentanol, isoamyl acetate, amyl acetate, isoamyl propionate, isoamyl nonanoate, isobutyl acetate, methyl butyrate, methyl caproate, methyl caprylate, ethyl tert-butyl ether, tert-amyl methyl ether, tert-amyl ethyl ether, tert-hexyl methyl ether, diisopropyl ether, methyl tert-butyl ether, or a combination thereof. Preferably the octane booster can comprise at least one of ethyl tert-butyl ether, tert-amyl methyl ether, tert-amyl ethyl ether, tert-hexyl methyl ether, diisopropyl ether, methyl tert-butyl ether or a combination thereof. In certain embodiments, the octane booster does not contain methyl tert-butyl ether.

The unleaded gasoline composition can be prepared by combining an unleaded gasoline, the mixed butanol, and the distillate oil fraction disclosed herein, and optionally an additional octane booster or other additive, either separately or in any combination.

The distillate oil fraction can be added directly to the unleaded gasoline. However, the distillate oil fraction can be diluted with a substantially inert, normally liquid organic diluent such as mineral oil, naphtha, benzene, toluene, or xylene, to form an additive concentrate. These concentrates can comprise 0.1 to 80% by weight, or 1% to 80% by weight, or 10% to 80% by weight, of the distillate oil fraction and can contain, in addition, one or more other additives known in the art as described below. Concentrations such as 15%, 20%, 30% or 50% by weight or higher can be used. The concentrates can be prepared by combining the desired components in any order at any temperature, for example at 23 to 70° C.

The additive concentrate or the unleaded gasoline composition can further comprise other additives known in the art, for example an additional octane-booster as disclosed above, anti-foam agents, anti-icing agents, additional anti-knock agents, anti-oxidants, anti-wear agents, color stabilizers, corrosion inhibitors, detergents, dispersants, dyes, extreme pressure agents, lead scavengers, metal deactivators, pour point depressing agents, upper-cylinder lubricants, viscosity improvers, and the like. The amounts of such additives depend on the particular additive, and can be readily determined by one of ordinary skill in the art.

Anti-foam agents used to reduce or prevent the formation of stable foam include silicones or organic polymers. Anti-oxidants, corrosion inhibitors, and extreme pressure agents are exemplified by chlorinated aliphatic hydrocarbons, organic sulfides and polysulfides, phosphorus esters including dihydrocarbon and trihydrocarbon phosphites, molybdenum compounds, and the like. Other anti-oxidants alkylated diphenyl amines, hindered phenols, especially those having tertiary alkyl groups such as tertiary butyl groups in the position ortho to the phenolic —OH group, and the like.

Detergents and dispersants can be of the ash-producing or ashless type. The ash-producing detergents are exemplified by oil-soluble neutral and basic salts of alkali or alkaline earth metals with sulfonic acids, carboxylic acids, phenols, or organic phosphorus acids characterized by a least one direct carbon-to-phosphorus linkage. Ashless detergents and dispersants can yield a nonvolatile residue such as boric oxide or phosphorus pentoxide upon combustion, but do not ordinarily contain metal and therefore does not yield a metal-containing ash on combustion. Examples include reaction products of carboxylic acids (or derivatives thereof) containing 34 to 54 carbon atoms with nitrogen containing compounds such as amine, organic hydroxy compounds such as phenols and alcohols, and/or basic inorganic materials.

Viscosity improvers are usually polymers, for example polyisobutenes, poly(methacrylic acid esters), hydrogenated diene polymers, polyalkyl styrenes, esterified styrene-maleic anhydride copolymers, hydrogenated alkenylarene-conjugated diene copolymers, and polyolefins.

Also disclosed is an octane-enhancing additive comprising 5 to 95 vol. % of a mixed butanol and 5 to 95 vol. % of the distillate oil fraction, based on the total volume of the octane-enhancing additive.

This disclosure is further illustrated by the following examples, which are non-limiting.

EXAMPLES

The following test methods were used in the Examples.

Reid vapor pressure ("Rvp") is a measure of the volatility of gasoline. It is defined as the absolute vapor pressure exerted by a liquid (e.g., gasoline) at 100° F. (37.8° C.) as determined by test method ASTM D 323.

Research octane number ("RON") describes knocking behavior at a low engine load and low rotational speeds and is determined according to ASTM D 2699.

Motor octane number ("MON") describes knocking behavior at a high engine load and under high thermal stress and is determined according to ASTM D 2700.

A base unleaded gasoline comprising a major amount of hydrocarbons (greater than 50 vol. %) boiling in the range from 30° C. to 230° C. and having the properties shown in Table 1 was used in the Examples. In Table 1 the density is reported as kilograms per liter ("kg/l").

TABLE 1

Typical Physical Properties of Base Gasoline

| Test | Test Method | Result |
|---|---|---|
| Density at 15.0° C. (kg/l) | ASTM D4052 | 0.7580 |
| RVP | ASTM D323 | 6.9 psi |
| Doctor Test | ASTM D4952 | positive |
| Oxygenates | ASTM D4815 | Not Detected |
| Total Aromatics (fluorescent indicator adsorption) | ASTM D1319 | 36.0 vol. % |
| Total Aromatics (gas chromatography) | ASTM D5580 | 35.68 vol. % |
| Olefins (fluorescent indicator adsorption) | ASTM D1319 | 7.98 vol. % |
| RON | ASTM D2699 | 89.5 |
| MON | ASTM D2700 | 81.5 |

Example 1. Gasoline Blends Containing Mixed Butanol or MTBE

Each of MTBE and mixed butanol acts as an octane booster when blended with a base gasoline.

The base gasoline was combined with 5 to 20 vol. % of mixed butanol, based on the total volume of the gasoline composition.

RON and MON were determined for gasoline blend compositions comprising mixed butanol at a concentration varying from 0 to 20 vol. %, as shown in Table 2 below. The results are also shown graphically in FIG. 1. In Table 2, the total volume of each Blend sample is 100 vol. %.

TABLE 2

Octane Numbers determined for Gasoline Blends

| Blend sample | vol. % Mixed Butanol | RON | MON |
|---|---|---|---|
| Base gasoline (X) at 100 vol. % | 0 | 89.5 | 81.5 |
| 5 vol. % Mixed butanol (SUPERBUTOL ™) + (95 vol. % X) | 5 | 90.3 | 82.0 |
| 10 vol. % Mixed butanol (SUPERBUTOL ™) + (90 vol. % X) | 10 | 90.9 | 82.6 |
| 15 vol. % Mixed butanol (SUPERBUTOL ™) + (85 vol. % X) | 15 | 91.9 | 83.4 |
| 20 vol. % Mixed butanol (SUPERBUTOL ™) + (80 vol. % X) | 20 | 93.0 | 84.0 |

The resultant gasoline compositions have RON in the range of 90 to 93 and MON in the range of 82 to 84.

The RON data for gasoline blends containing 5 to 20 vol. % MTBE, are tabulated below in Table 3. In Table 3, the total volume of each Sample is 100 vol. %. In Table 3, it is noted that 5% MTBE plus (x) refers to 5 vol. % MTBE plus 95 vol. % base gasoline, 10% MTBE plus (x) refers to 10 vol. % MTBE plus 90 vol. % base gasoline, 15% MTBE plus (x) refers to 15 vol. % MTBE plus 85 vol. % base gasoline, and 20% MTBE plus (x) refers to 20 vol. % MTBE plus 80 vol. % base gasoline.

TABLE 3

RON values for MTBE-containing gasoline blends

| Sample | RON |
|---|---|
| Base gasoline (X) | 89.5 |
| 5% MTBE + (x) | 91.3 |
| 10% MTBE + (x) | 92.6 |
| 15% MTBE + (x) | 94 |
| 20% MTBE + (x) | 95.1 |

Figure 2:
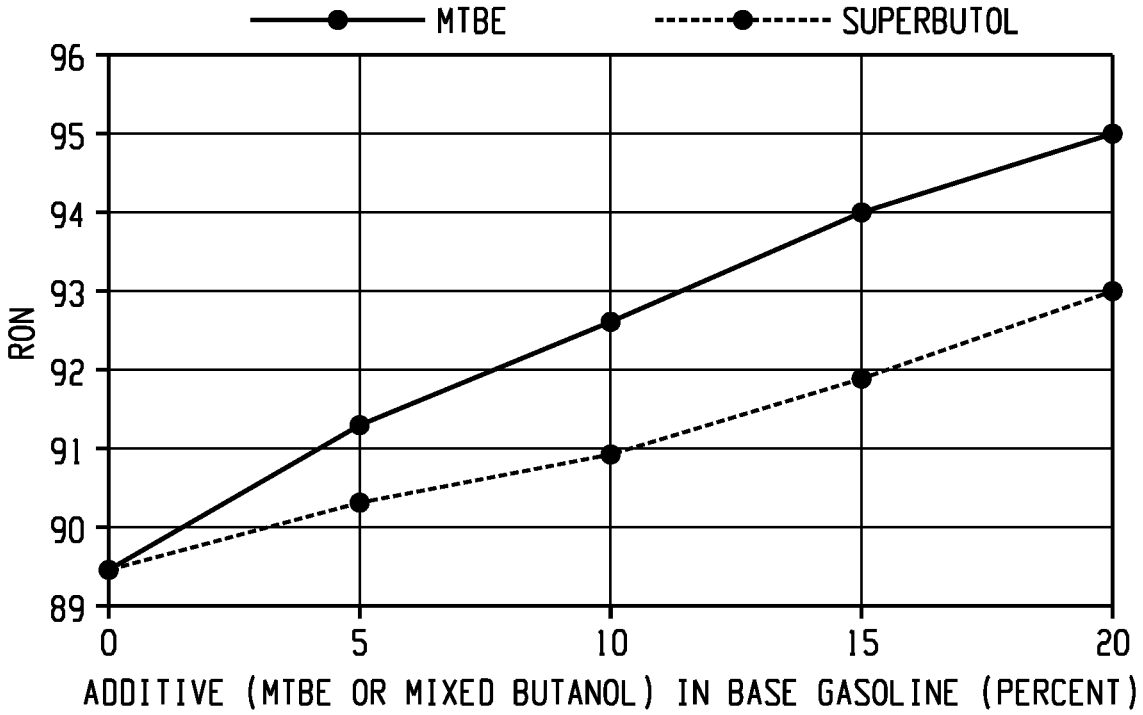
FIG. 2 is a graph of RON as a function of amount of octane booster in the gasoline blend, for gasoline blends containing various amounts of MTBE or mixed butanol ("SUPERBUTOL").

FIG. 2 shows a graphical comparison of RON for gasoline blends containing various amounts of MTBE or mixed butanol. Comparison of the RON for gasoline blends with either MTBE or mixed butanol shows the MTBE-containing gasoline compositions have higher RON values compared to mixed butanol at the same vol. %.

Example 2. Gasoline Blends with Mixed Butanol and Special Oil Fraction

The base gasoline was combined with 20 vol. % of a mixed butanol and 10 to 30 vol. % of a special oil fraction ("SOF"), each based on the total volume of the gasoline composition. The composition of the special oil fraction (e.g., distillate oil fraction) used in the Examples is shown in Table 4. The composition was analyzed by a gas chromatographic method, followed by mass spectrometry, in accordance with ASTM D6730.

TABLE 4

Composition of Special Oil Fraction

| Test | Method | Unit | Special Oil Fraction (vol. %) |
|---|---|---|---|
| Initial Boiling Point* - 180° C. Cut | | | |
| n-Paraffins | ASTM D6730 | vol. % | 0.42 |
| Iso-Paraffins | ASTM D6730 | vol. % | 29.34 |
| Total Paraffins | ASTM D6730 | vol. % | 29.76 |
| Olefins | ASTM D6730 | vol. % | 8.99 |
| Naphthenes | ASTM D6730 | vol. % | 4.53 |
| Aromatics | ASTM D6730 | vol. % | 52.47 |

RON, MON, and Rvp were determined for the gasoline blend compositions.

Figure 3:
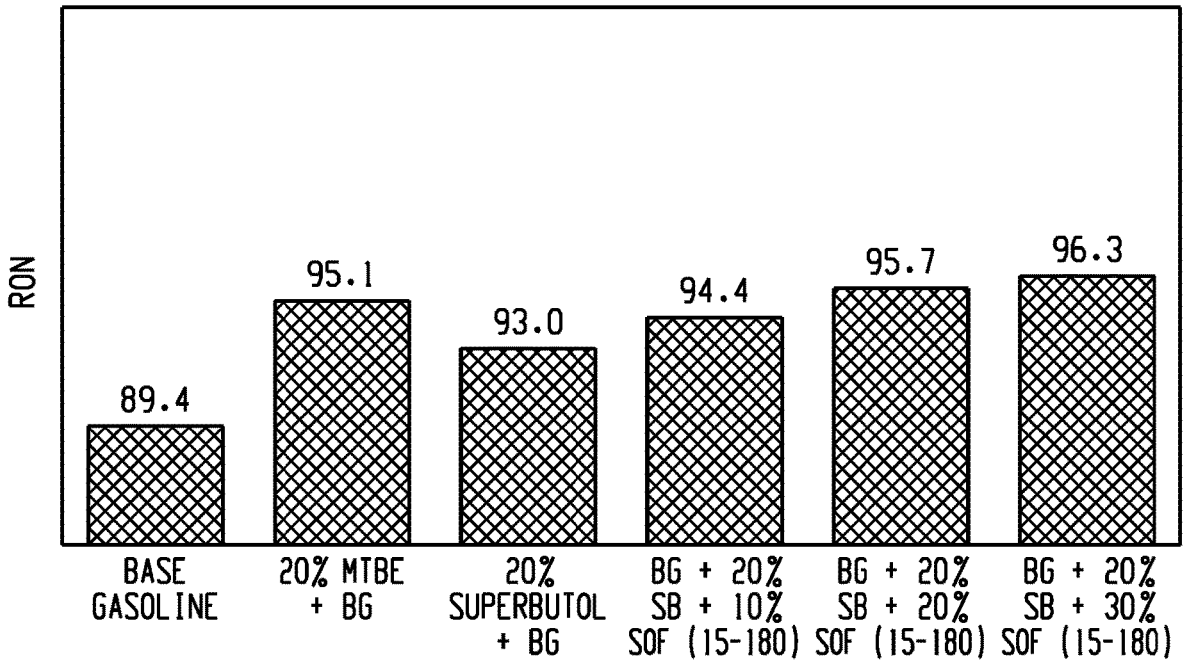
FIG. 3 is a histogram comparing RON for a base gasoline ("BG") and gasoline blends comprising 20 vol. % MTBE, 20 vol. % mixed butanol ("SUPERBUTOL" or "SB"), or 20 vol. % mixed butanol and 10 to 30 vol. % special oil fraction ("SOF").

FIG. 3 is a histogram comparing RON for the base gasoline and gasoline blends comprising 20 vol. % MTBE (plus 80 vol. % base gasoline), 20 vol. % mixed butanol (plus 80 vol. % base gasoline), or 20 vol. % mixed butanol and 10 to 30 vol. % SOF (plus remainder to 100 vol. % with base gasoline), respectively. The resultant gasoline compositions comprising mixed butanol and the SOF can have RON in the range of 94 to 96.3.

RON of the gasoline blend compositions comprising mixed butanol and the special oil fraction increases as the percentage of special oil fraction increases (10-30 vol. %) at a constant percent mixed butanol. In particular, gasoline blend compositions comprising SOF and mixed butanol can achieve octane numbers comparable to or higher than those obtained by gasoline blends using MTBE as the sole octane booster. The MON of the gasoline blend compositions shows a similar trend.

Figure 4:
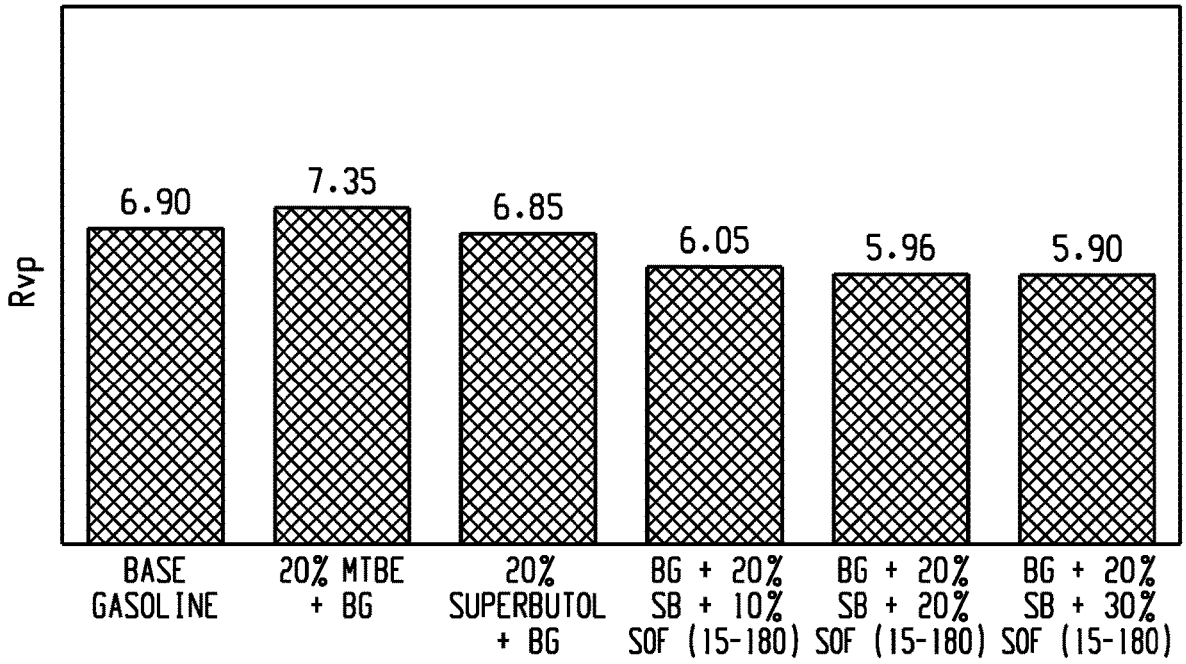
FIG. 4 is a histogram comparing Reid vapor pressure ("Rvp") for a base gasoline and gasoline blends comprising 20 vol. % MTBE, 20 vol. % mixed butanol, or 20 vol. % mixed butanol and 10 to 30 vol. % SOF.

FIG. 4 is a histogram comparing Rvp for the base gasoline and the gasoline blends comprising 20 vol. % MTBE (plus 80 vol. % base gasoline), 20 vol. % mixed butanol (plus 80 vol. % base gasoline), or 20 vol. % mixed butanol and 10 to 30 vol. % SOF (plus remainder to 100 vol. % with base gasoline), respectively. The Rvp of the gasoline blend compositions decreases as the percentage of the special oil fraction increases (10-30 vol. %) at a constant percent mixed butanol. The Rvp of these gasoline compositions is substantially lower than that of the gasoline composition with 20 vol. % MTBE, while having comparable or higher RON.

Addition of mixed butanol and the special oil fraction to the base gasoline improves the properties of the gasoline composition, increasing overall octane number for the blend, thereby providing better combustion and improved performance for the automobile market, while lowering Rvp thereby minimizing release of volatiles that can contribute to ground-level ozone and ozone-related health problems.

Figure 5:
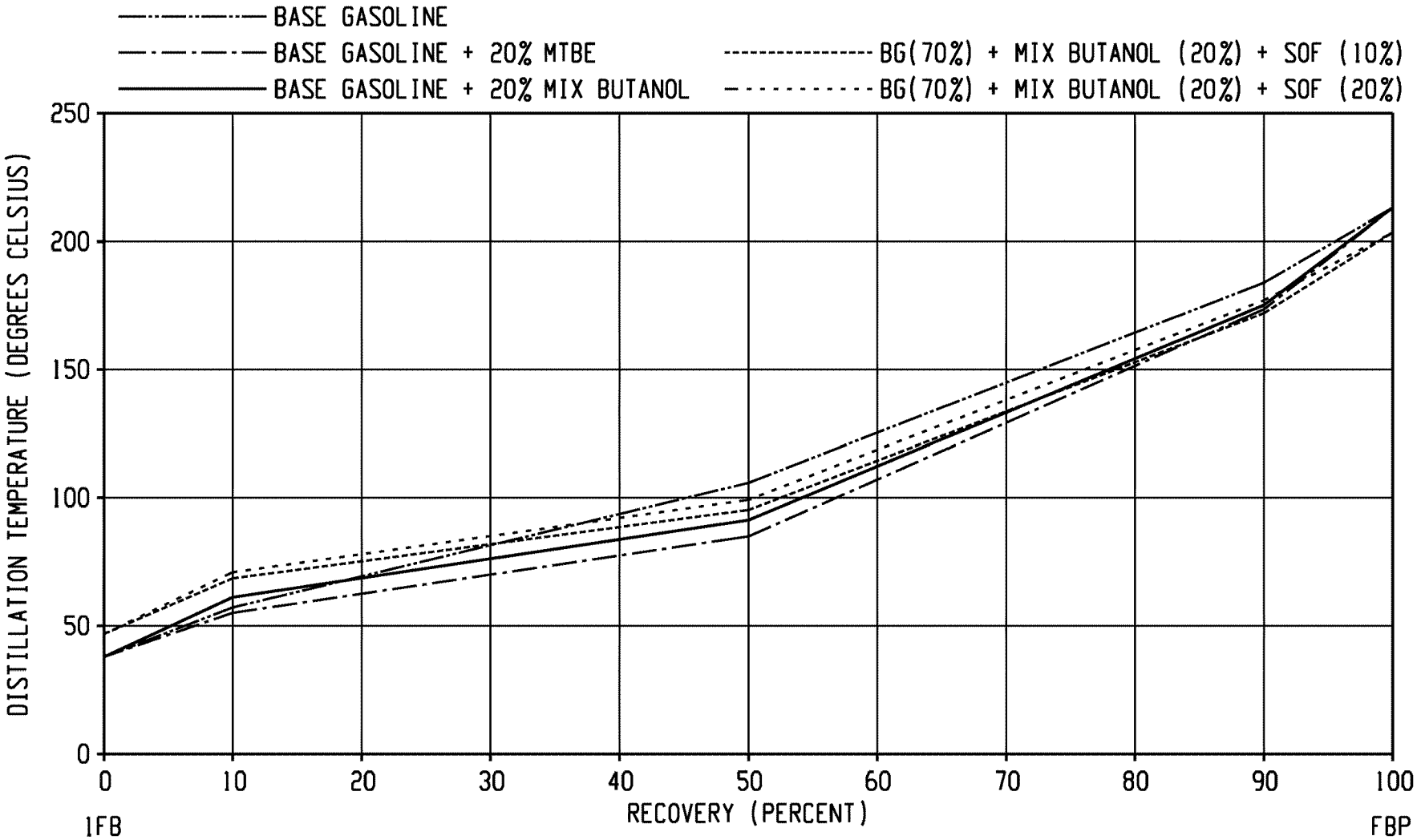
FIG. 5 is a graph of distillation temperature vs. percent recovery performed in accordance with ASTM D86 for various compositions. "IFB" is initial boiling point and "FBP" is final boiling point.

FIG. 5 is a graph showing the distillation temperature profile of a base gasoline compared to a gasoline blend with 20 vol. % MTBE (plus 80 vol. % base gasoline), a gasoline blend with 20 vol. % mixed butanol (plus 80 vol. % base gasoline), a gasoline blend with 20 vol. % mixed butanol plus 10 vol. % special fraction oil (plus 70 vol. % base gasoline), and a gasoline blend with 20 vol. % mixed butanol plus 20 vol. % special fraction oil (plus 60 vol. % base gasoline).

In sum, the evaluated properties show that use of the cost-effective octane-boosting components mixed butanol and SOF in a gasoline blend, rather than the higher-priced MTBE, can yield similar performance characteristics (octane numbers).

This disclosure further encompasses the following aspects.

Aspect 1: An unleaded gasoline composition comprises 50 to 96 vol. % of an unleaded gasoline; 2 to 20 vol. % of a mixed butanol; and 2 to 30 vol. % of a distillate oil fraction comprising a paraffin, an olefin, a naphthene, and an aromatic at an initial boiling point cut of 180° C., wherein the unleaded gasoline, the mixed butanol, and the distillate oil fraction are selected to provide the unleaded gasoline composition with a Research Octane Number of 90 to 101, determined in accordance with ASTM D 2699; and a Motor Octane Number of 81.4 to 90, determined in accordance with ASTM D 2700.

Aspect 2: The unleaded gasoline composition of Aspect 1, having a Reid vapor pressure, determined in accordance with ASTM D323, at least 2.1 kPa (0.3 psi) lower, at least 2.8 kPa (0.4 psi) lower, at least 3.4 kPa (0.5 psi) lower, at least 4.8 kPa (0.7 psi) lower, at least 6.2 kPa (0.9 psi) lower, or at least at least 6.9 kPa (1.0 psi) lower than the unleaded gasoline without the mixed butanol and the distillate oil fraction.

Aspect 3: The unleaded gasoline composition of Aspect 1 or 2, wherein the mixed butanol comprises at least one of sec-butanol, tert-butanol, n-butanol, isobutanol, or a combination thereof.

Aspect 4: The unleaded gasoline composition of any one or more of Aspects 1 to 3 wherein the unleaded gasoline comprises greater than 50 vol. % of hydrocarbons having a boiling point in the range of 30° C. to 230° C., based on the total volume of the unleaded gasoline.

Aspect 5: The unleaded gasoline composition of any one or more of Aspects 1 to 4 wherein the distillate oil fraction comprises 0.08 to 5 vol. % of n-paraffins; 20 to 40 vol. % of iso-paraffins; 2 to 16 vol. % of olefins; 0.5 to 12 vol. % of naphthenes; and 35 to 65 vol. % of aromatics, based on the total volume of the distillate oil fraction; wherein the vol. % of the n-paraffins, iso-paraffins, olefins, naphthenes and aromatics of the distillate oil fraction is determined in accordance with ASTM D6730.

Aspect 6: The unleaded gasoline composition of any one or more of Aspects 1 to 4, wherein the distillate oil fraction comprises 0.15 to 1.5 vol. % of n-paraffins, 24 to 35 vol. % of iso-paraffins, 5 to 13 vol. % of olefins, 1 to 9 vol. % of naphthenes, and 45 to 60 vol. % of aromatics, based on the total volume of the distillate oil fraction; wherein the vol. % of the n-paraffins, iso-paraffins, olefins, naphthenes and aromatics of the distillate oil fraction is determined in accordance with ASTM D6730.

Aspect 7: The unleaded gasoline composition of any one or more of Aspects 1 to 6, further comprising 1 to 15 vol. %, based on the total volume of the unleaded gasoline composition, of an octane booster comprising at least one of a monoaromatic compound, alcohol, ester, or ether octane booster, wherein the alcohol is not a butanol.

Aspect 8: The unleaded gasoline composition of Aspect 7, wherein the octane booster comprises at least one of xylene, benzene, toluene, aniline, ethanol, methanol, ethanol, isopropyl alcohol, n-propyl alcohol, tert-amyl alcohol, tert-pentanol, isoamyl acetate, amyl acetate, isoamyl propionate, isoamyl nonanoate, isobutyl acetate, methyl butyrate, methyl caproate, methyl caprylate, ethyl tert-butyl ether, tert-amyl methyl ether, tert-amyl ethyl ether, tert-hexyl methyl ether, diisopropyl ether, methyl tert-butyl ether, or a combination thereof, preferably the octane booster comprises at least one of ethyl tert-butyl ether, tert-amyl methyl ether, tert-amyl ethyl ether, tert-hexyl methyl ether, diisopropyl ether, methyl tert-butyl ether or a combination thereof.

Aspect 9: The unleaded gasoline composition of Aspect 8, wherein the octane booster does not contain methyl tert-butyl ether.

Aspect 10: A method for preparing an unleaded gasoline composition, comprising combining 50 to 96 vol. % of an unleaded gasoline, based on the total volume of the unleaded gasoline composition; 2 to 20 vol. % of a mixed butanol, based on the total volume of the unleaded gasoline composition; and 2 to 30 vol. %, based on the total volume of the unleaded gasoline composition, of a distillate oil fraction comprising, a paraffin, an olefin, a naphthene, and an aromatic at an initial boiling point cut of 180° C., wherein the unleaded gasoline, the mixed butanol, and the distillate oil fraction are selected to provide the unleaded gasoline composition with a Research Octane Number of 91 to 101, determined in accordance with ASTM D 2699; and a Motor Octane Number of 81.4 to 90, determined in accordance with ASTM D 2700; and wherein the total volume of the unleaded gasoline composition is 100 vol. %.

Aspect 11: The method of Aspect 10, wherein the mixed butanol comprises at least one of sec-butanol, tert-butanol, n-butanol, isobutanol, or a combination thereof.

Aspect 12: The unleaded gasoline composition of Aspect 10 or 11, wherein the unleaded gasoline comprises greater than 50 vol. % of hydrocarbons having a boiling point of 30 to 230° C., based on the total volume of the unleaded gasoline.

Aspect 13: The method of any one of Aspects 10 to 12, wherein the distillate oil fraction comprises 0.08 to 5 vol. % of n-paraffins; 20 to 40 vol. % of iso-paraffins; 2 to 16 vol. % of olefins; 0.5 to 12 vol. % of naphthenes; and 35 to 65 vol. % of aromatics, based on the total volume of the distillate oil fraction; wherein the vol. % of the n-paraffins, iso-paraffins, olefins, naphthenes and aromatics of the distillate oil fraction is determined in accordance with ASTM D6730.

Aspect 14: The method of any one of Aspects 10 to 12, wherein the distillate oil fraction comprises 0.15 to 1.5 vol. % of n-paraffins; 24 to 35 vol. % of iso-paraffins; 5 to 13 vol. % of olefins; 1 to 9 vol. % of naphthenes; and 45 to 60 vol. % of aromatics, based on the total volume of the distillate oil fraction; wherein the vol. % of the n-paraffins, iso-paraffins, olefins, naphthenes and aromatics of the distillate oil fraction is determined in accordance with ASTM D6730.

Aspect 15: An octane-enhancing additive comprising 5 to 95 vol. % of a mixed butanol and 5 to 95 vol. % of a distillate oil fraction comprising a paraffin, an olefin, a naphthene, and an aromatic at an initial boiling point cut of 180° C., based on the total volume of the octane-enhancing additive; wherein the total volume of the octane-enhancing additive is 100 vol. %.

Aspect 16: The octane-enhancing additive of Aspect 15, wherein the mixed butanol comprises at least one of sec-butanol, tert-butanol, n-butanol, isobutanol, or a combination thereof.

Aspect 17: The octane-enhancing additive of Aspect 15 or 16, wherein the distillate oil fraction comprises 0.08 to 5 vol. % of n-paraffins; 20 to 40 vol. % of iso-paraffins; 2 to 16 vol. % of olefins; 0.5 to 12 vol. % of naphthenes; and 35 to 65 vol. % of aromatics, based on the total volume of the distillate oil fraction; wherein the vol. % of the n-paraffins, iso-paraffins, olefins, naphthenes and aromatics of the distillate oil fraction is determined in accordance with ASTM D6730.

Aspect 18: The octane-enhancing additive of Aspect 15 or 16, wherein the distillate oil fraction comprises 0.15 to 1.5 vol. % of n-paraffins, and 24 to 35 vol. % of iso-paraffins, based on the total volume of the distillate oil fraction; wherein the vol. % of the n-paraffins and iso-paraffins of the distillate oil fraction is determined in accordance with ASTM D6730.

Aspect 19: The octane-enhancing additive of Aspect 18, wherein the distillate oil fraction comprises 5 to 13 vol. % of olefins, and 1 to 9 vol. % of naphthenes, based on the total volume of the distillate oil fraction; wherein the vol. % of the olefins and naphthenes of the distillate oil fraction is determined in accordance with ASTM D6730.

Aspect 20: The octane-enhancing additive of Aspect 19, wherein the distillate oil fraction comprises 45 to 60 vol. % of aromatics, based on the total volume of the distillate oil fraction; wherein the vol. % of the aromatics of the distillate oil fraction is determined in accordance with ASTM D6730.

The compositions, methods, and articles can alternatively comprise, consist of, or consist essentially of, any appropriate materials, steps, or components herein disclosed. The compositions, methods, and articles can additionally, or alternatively, be formulated so as to be devoid, or substantially free, of any materials (or species), steps, or components, that are otherwise not necessary to the achievement of the function or objectives of the compositions, methods, and articles.

All ranges disclosed herein are inclusive of the endpoints, and the endpoints are independently combinable with each other (e.g., ranges of "up to 25 wt. %, or, more specifically, 5 wt. % to 20 wt. %", is inclusive of the endpoints and all intermediate values of the ranges of "5 wt. % to 25 wt. %," etc.). "Combinations" is inclusive of blends, mixtures, reaction products, and the like. The terms "a" and "an" and "the" do not denote a limitation of quantity, and are to be construed to cover both the singular and the plural, unless otherwise indicated herein or clearly contradicted by context. "Or" means "and/or" unless clearly stated otherwise. Reference throughout the specification to "some embodiments", "an embodiment", and so forth, means that a particular element described in connection with the embodiment is included in at least one embodiment described herein, and may or may not be present in other embodiments. In addition, it is to be understood that the described elements may be combined in any suitable manner in the various embodiments. In a list of alternatively useable species, "a combination thereof" means that the combination can include a combination of at least one element of the list with one or more like elements not named. Also, "at least one of" means that the list is inclusive of each element individually, as well as combinations of two or more elements of the list, and combinations of at least one element of the list with like elements not named.

Unless specified to the contrary herein, all test standards are the most recent standard in effect as of the filing date of this application, or, if priority is claimed, the filing date of the earliest priority application in which the test standard appears. Stated another way, all test standards and methods, such as ASTM, AOCS, and ISO, are the most recent standard as of Apr. 2, 2019, unless specified otherwise.

Unless defined otherwise, technical and scientific terms used herein have the same meaning as is commonly understood by one of skill in the art to which this application belongs. All cited patents, patent applications, and other references are incorporated herein by reference in their entirety. However, if a term in the present application contradicts or conflicts with a term in the incorporated reference, the term from the present application takes precedence over the conflicting term from the incorporated reference.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. An unleaded gasoline composition comprising:

50 to 96 vol. % of an unleaded gasoline, based on the total volume of the unleaded gasoline composition;

2 to 20 vol. % of a mixed butanol, based on the total volume of the unleaded gasoline composition, wherein the mixed butanol comprises two or more selected from the group consisting of sec-butanol, tert-butanol, n-butanol, and isobutanol; and 2 to 30 vol. %, based on the total volume of the unleaded gasoline composition, of a distillate oil fraction having an initial boiling point cut of 180° C. comprising a paraffin, an olefin, a naphthene, and an aromatic, wherein the unleaded gasoline, the mixed butanol, and the distillate oil fraction are selected to provide the unleaded gasoline composition with a Research Octane Number of 90 to 101, determined in accordance with ASTM D 2699;

and a Motor Octane Number of 81.4 to 90, determined in accordance with ASTM D 2700;

wherein the total volume of the unleaded gasoline composition is 100 vol. %.

2. The unleaded gasoline composition of claim 1, having a Reid vapor pressure, determined in accordance with ASTM D323, at least 2.1 kPa (0.3 psi) lower than the unleaded gasoline without the mixed butanol and the distillate oil fraction.

3. The unleaded gasoline composition of claim 1, wherein the unleaded gasoline comprises greater than 50 vol. % of hydrocarbons having a boiling point in the range of 30° C. to 230° C., based on the total volume of the unleaded gasoline.

4. The unleaded gasoline composition of claim 1, wherein the distillate oil fraction comprises:

0.08 to 5 vol. % of n-paraffins, 20 to 40 vol. % of iso-paraffins, 2 to 16 vol. % of olefins, 0.5 to 12 vol. % of naphthenes, and 35 to 65 vol. % of aromatics, based on the total volume of the distillate oil fraction;

wherein the vol. % of the n-paraffins, iso-paraffins, olefins, naphthenes and aromatics of the distillate oil fraction is determined in accordance with ASTM D6730.

5. The unleaded gasoline composition of claim 1, wherein the distillate oil fraction comprises:

0.15 to 1.5 vol. % of n-paraffins, 24 to 35 vol. % of iso-paraffins, 5 to 13 vol. % of olefins, 1 to 9 vol. % of naphthenes, and 45 to 60 vol. % of aromatics, based on the total volume of the distillate oil fraction;

wherein the vol. % of the n-paraffins, iso-paraffins, olefins, naphthenes and aromatics of the distillate oil fraction is determined in accordance with ASTM D6730.

6. The unleaded gasoline composition of claim 1, further comprising 1 to 15 vol. %, based on the total volume of the unleaded gasoline composition, of an octane booster comprising at least one of a monoaromatic compound, alcohol, ester, or ether, wherein the alcohol is not a butanol.

7. The unleaded gasoline composition of claim 6, wherein the octane booster comprises at least one of xylene, benzene, toluene, aniline, ethanol, methanol, ethanol, isopropyl alcohol, n-propyl alcohol, tert-amyl alcohol, tert-pentanol, isoamyl acetate, amyl acetate, isoamyl propionate, isoamyl nonanoate, isobutyl acetate, methyl butyrate, methyl caproate, methyl caprylate, ethyl tert-butyl ether, tert-amyl methyl ether, tert-amyl ethyl ether, tert-hexyl methyl ether, diisopropyl ether, methyl tert-butyl ether, or a combination thereof.

8. The unleaded gasoline composition of claim 7, wherein the octane booster does not contain methyl tert-butyl ether.

9. A method for preparing an unleaded gasoline composition, comprising:

combining 50 to 96 of an unleaded gasoline, based on the total volume of the unleaded gasoline composition;

2 to 20 vol. % of a mixed butanol, based on the total volume of the unleaded gasoline composition, wherein the mixed butanol comprises two or more selected from the group consisting of sec-butanol, tert-butanol, and isobutanol; and 2 to 30 vol. %, based on the total volume of the unleaded gasoline composition, of a distillate oil fraction having an initial boiling point cut of 180° C. comprising, a paraffin, an olefin, a naphthene, and an aromatic, wherein the unleaded gasoline, the mixed butanol, and the distillate oil fraction are selected to provide the unleaded gasoline composition with a Research Octane Number of 91 to 101, determined in accordance with ASTM D 2699; and a Motor Octane Number of 81.4 to 90, determined in accordance with ASTM D 2700;

wherein the total volume of the unleaded gasoline composition is 100 vol %.

10. The unleaded gasoline composition of claim 9, wherein the unleaded gasoline comprises greater than 50 vol. % of hydrocarbons having a boiling point of 30 to 230° C., based on the total volume of the unleaded gasoline.

11. The method of claim 9, wherein the distillate oil fraction comprises:

0.08 to 5 vol. % of n-paraffins, 20 to 40 vol. % of iso-paraffins, 2 to 16 vol. % of olefins, 0.5 to 12 vol. % of naphthenes, and 35 to 65 vol. % of aromatics, based on the total volume of the distillate oil fraction;

wherein the vol. % of the n-paraffins, iso-paraffins, olefins, naphthenes and aromatics of the distillate oil fraction is determined in accordance with ASTM D6730.

12. The method of claim 9, wherein the distillate oil fraction comprises:

0.15 to 1.5 vol. % of n-paraffins, 24 to 35 vol. % of iso-paraffins, 5 to 13 vol. % of olefins, 1 to 9 vol. % of naphthenes, and 45 to 60 vol. % of aromatics, based on the total volume of the distillate oil fraction;

wherein the vol. % of the n-paraffins, iso-paraffins, olefins, naphthenes and aromatics of the distillate oil fraction is determined in accordance with ASTM D6730.

13. An octane-enhancing additive comprising 5 to 95 vol. % of a mixed butanol, wherein the mixed butanol comprises two or more selected from the group consisting of sec-butanol, tert-butanol, n-butanol, and isobutanol, and 5 to 95 vol % of a distillate oil fraction having an initial boiling point cut of 180° C. comprising a paraffin, an olefin, a naphthene, and an aromatic, based on the total volume of the octane-enhancing additive;

wherein the total volume of the octane-enhancing additive is 100 vol. %.

14. The octane-enhancing additive of claim 13, wherein the distillate oil fraction comprises:

0.08 to 5 vol. % of n-paraffins, 20 to 40 vol. % of iso-paraffins, 2 to 16 vol. % of olefins, 0.5 to 12 vol. % of naphthenes, and 35 to 65 vol. % of aromatics, based on the total volume of the distillate oil fraction;

wherein the vol. % of the n-paraffins, iso-paraffins, olefins, naphthenes and aromatics of the distillate oil fraction is determined in accordance with ASTM D6730.

15. The octane-enhancing additive of claim 13, wherein the distillate oil fraction comprises:

0.15 to 1.5 vol. % of n-paraffins, and 24 to 35 vol. % of iso-paraffins, based on the total volume of the distillate oil fraction;

wherein the vol. % of the n-paraffins and iso-paraffins of the distillate oil fraction is determined in accordance with ASTM D6730.

16. The octane-enhancing additive of claim 15, wherein the distillate oil fraction comprises:

5 to 13 vol. % of olefins, and 1 to 9 vol. % of naphthenes, based on the total volume of the distillate oil fraction;

wherein the vol. % of the olefins and naphthenes of the distillate oil fraction is determined in accordance with ASTM D6730.

17. The octane-enhancing additive of claim 16, wherein the distillate oil fraction comprises:

45 to 60 vol. % of aromatics, based on the total volume of the distillate oil fraction;

wherein the vol. % of the aromatics of the distillate oil fraction is determined in accordance with ASTM D6730.

* * * * *